US005191170A

United States Patent [19]

Yoshida et al.

[11] Patent Number: 5,191,170

[45] Date of Patent: Mar. 2, 1993

[54] DEVELOPING APPARATUS HAVING DEVELOPING AGENT LAYER FORMING BLADE

[75] Inventors: Minoru Yoshida, Tokyo; Kouji Hirano, Yokosuka, both of Japan

[73] Assignee: Kabushiki Kaisha Toshiba, Kawasaki, Japan

[21] Appl. No.: 795,532

[22] Filed: Nov. 21, 1991

[30] Foreign Application Priority Data

Nov. 30, 1990 [JP] Japan ..... 2-340514

[51] Int. Cl.[5] ..... G03G 15/06

[52] U.S. Cl. ..... 118/644; 355/245

[58] Field of Search ..... 355/245, 246, 259; 118/644, 653, 656

[56] References Cited

U.S. PATENT DOCUMENTS

| | | | |
|---|---|---|---|
| 4,505,573 | 3/1985 | Brewington et al. | 118/653 X |
| 4,586,460 | 5/1986 | Kohyama et al. | 118/653 |
| 4,760,422 | 7/1988 | Seimiya et al. | 118/656 X |
| 5,057,871 | 10/1991 | Hirose et al. | 355/259 |
| 5,076,201 | 12/1991 | Nishio et al. | 355/259 X |

*Primary Examiner*—A. T. Grimley
*Assistant Examiner*—William J. Royer
*Attorney, Agent, or Firm*—Foley & Lardner

[57] ABSTRACT

A developing apparatus includes a developing roller having a conductive layer, and a developer layer forming blade for forming a developer layer on the developing roller. The developer layer forming blade is formed of a layered member having a charging layer, and the conductive layer of the developing roller has wear-resistance equal to or higher than that of the charging layer of the developer layer forming blade.

14 Claims, 7 Drawing Sheets

OPENING (1cmX20cm)

DEVELOPING APPARATUS HAVING DEVELOPING AGENT LAYER FORMING BLADE

BACKGROUND OF THE INVENTION

1. Field of the Invention

The present invention relates to a developing apparatus for visualizing an electrostatic latent image in an electrophotographic device or an electrostatic recording device and, more particularly, to a developing apparatus capable of forming a high-definition image using a single component system developer.

2. Description of the Related Art

In the impression development art a development method is known which uses a single component system developer, and is characterized in that an electrostatic latent image and a developer particle or a developer carrier are brought into contact with each other at a relative peripheral speed of substantially zero, which is disclosed in U.S. Pat. Nos. 3,152,012 and 3,731,148, Published Unexamined Japanese Patent Applications No. 47-13088 and 47-13089, etc., and has the advantages that the developing apparatus can be simplified and reduced in size, and the developer can be easily colored, since no magnetic material is used.

In impression development, an elastic and conductive development roller is required for performing development with the developer carrier impressed on or in contact with the electrostatic latent image. If an electrostatic latent image holding member is rigid, it is essential that the development roller be formed of an elastic member to prevent the rigid holding member from being damaged. As is well-known, it is desirable that a conductive layer be formed on or near the surface of the developing roller and a bias voltage be applied thereto in order to obtain a development electrode effect and a bias effect in the developing roller. Since electric charges are applied to the developer by triboelectric charging between the developing roller and a developer layer forming blade, the blade has to be pressed against the developing roller to ensure a fixed nip width.

To ensure that sufficient charges are applied, to the developer, it is desirable that a triboelectric charging series material be used in accordance with the polarity of the charges. In reversal development as used in a laser printer, a digital PPC, and the like, wherein a photosensitive drum is negatively charged and development is performed using developer charged to the same polarity as that of the photosensitive drum, negative charges are applied to the developer, and thus silicone rubber is frequently used, since it is easy to charge positively. However, when silicone rubber is used, the end portion of the blade quickly becomes worn due to the short lifetime of the silicone rubber, which may cause a problem.

SUMMARY OF THE INVENTION

The present invention is made to resolve the above prior art problems and its object is to provide a single component system developing apparatus in which a developing agent is sufficiently charged and high-definition images free from defects such as uniformless density and fogginess are formed using the developing agent, without changing the thickness of a developing agent layer, increasing in the amount of developing agent consumed, or degrading the images even for a long time.

According to the present invention, there is provided a developing apparatus comprising:

development means having a conductive layer; and developing agent layer forming means for forming a developing agent layer on the conductive layer of the development means, the developing agent layer forming means having a charging layer, and the conductive layer of the developing means having wear-resistance equal to or higher than that of the charging layer.

In the developing apparatus according to the present invention, since the charging layer of the developing agent layer forming means is worn more quickly than the conductive layer of the developing means, it is possible to prevent the conductive layer from being worn and to prevent marks, flaws, and peeling from occurring in the conductive layer. If the developing means and developing agent layer forming means are used, sufficient charges can be applied to the developing agent, thus high-definition images free from defects such as uniformless density and fogginess of non-image portions can be formed and the high-definition images can be maintained for a long time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and together with the general description given above and the detailed description of the preferred embodiments given below, serve to explain the principles of the invention.

DETAILED DESCRIPTION OF THE PREFERRED EMBODIMENTS

A developing apparatus according to the present invention comprises development means having a conductive layer formed on a surface thereof and arranged opposite to a latent image bearing member, for supplying developer to the latent image bearing member to develop an electrostatic latent image, and developer layer forming means for forming a developer layer on the developer means. In the developing apparatus, the developer layer formed on the developer means is made close to or put into contact with an electrostatic latent image holding member to visualize an electrostatic latent image. The developer layer forming means is formed of a layered member including a charging layer. The conductive layer of the development means has wear-resistance equal to or higher than the charging layer of the developer layer forming means.

A developing apparatus according to the present invention will be described in detail with reference to the accompanying drawings.

Figure 1A:
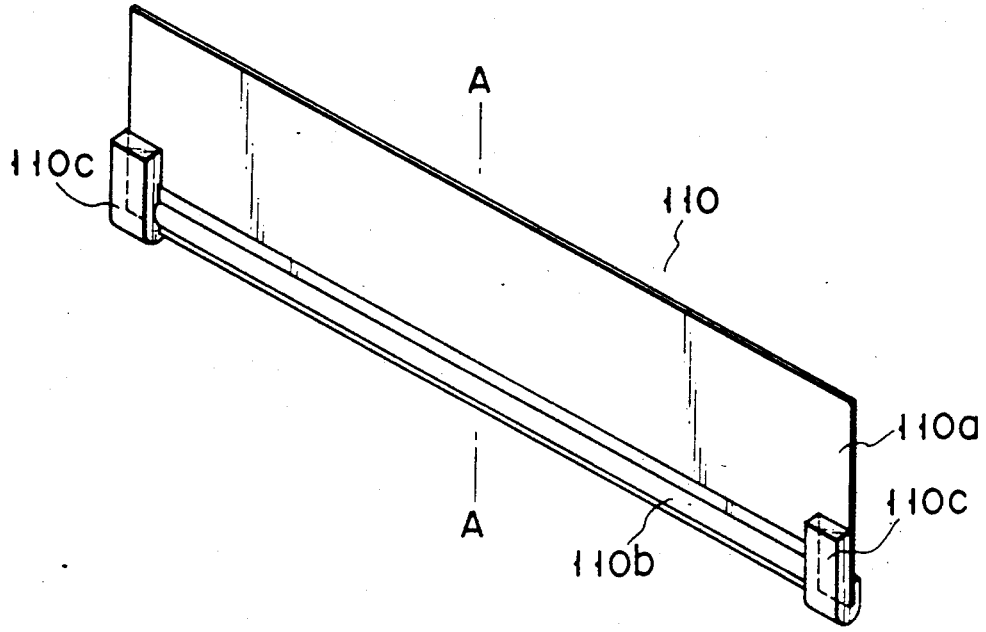
FIG. 1A is a perspective view showing an example of the developing layer forming blade used in the developing apparatus of the present invention.
Figure 1B:
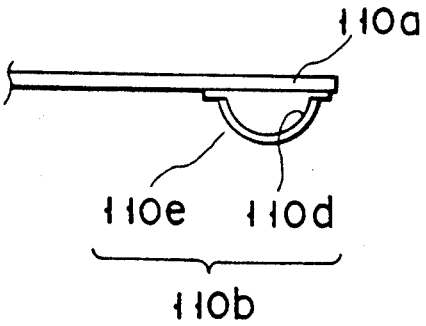
FIG. 1B is a cross-sectional view taken along line A—A of FIG. 1A.

FIG. 1A is a perspective view showing an example of a developer layer forming blade used in a developing apparatus of the present invention, and FIG. 1B is a cross-sectional view taken along line A—A of FIG. 1A. As shown in FIG. 1B, a developer layer forming blade 110 includes a metal leaf 110*a* made of stainless steel, beryllium bronze, phosphor bronze or the like, and a chip 110*b* having an elastic layer 110*d* made of resin or rubber such as silicone rubber, urethane rubber, etylene-propylene-diene terpolymer (EPDM) rubber, and acrylonitrile-butadiene rubber (NBR), having hardness of 30 to 85 degrees on Japanese Industrial Standards (JIS-A) and a charging layer 110*e* having a polarity opposite to that of a developer. The charging layer 110*e* is formed on the elastic layer 110*d*, and the chip 110*b* including these layers is arranged at an end portion of the metal leaf 110*a*. The elastic layer is used favorably when the developer layer forming blade is applied to a contact type non-magnetic single component developing apparatus. The reason is as follows. In the contact type developing apparatus, since the hardness of the surface of a developing roller is relatively low the chip of the developer layer forming blade requires some elasticity to prevent the surface of the developing roller from being damaged.

As shown in FIG. 1A, the chip 110*b* is bonded to one surface and one end of the metal leaf 110*a* so as to extend along the longitudinal direction of the metal leaf. Seal members 110*c* formed of urethane foam are attached to the metal leaf 110*a* so as to extend from one surface to the other surface thereof in order to seal both ends of the chip 110*b*. The chip 110*b* can be attached using a method such as bonding, fitting, and insertion, and any method can be used if the chip is attached to the metal leaf with high precision. A phosphor bronze plate whose thickness is preferably 0.2 mm can be used as the metal leaf 110*a*. Further, the thickness of the metal leaf 110*a* depends on a shape of the metal leaf and is about 0.1 to 2 mm.

As described above, the chip 110*b* has a two-layered structure of the elastic layer 110*d* and charging layer 110*e* formed thereon, and it is preferable to make the polarity of the charging layer 110*e* opposite to that of the developer. In the developing apparatus of the present invention, reversal development can be performed by negatively charging the developer and positively charging the charging layer 110*e*.

Figure 2:
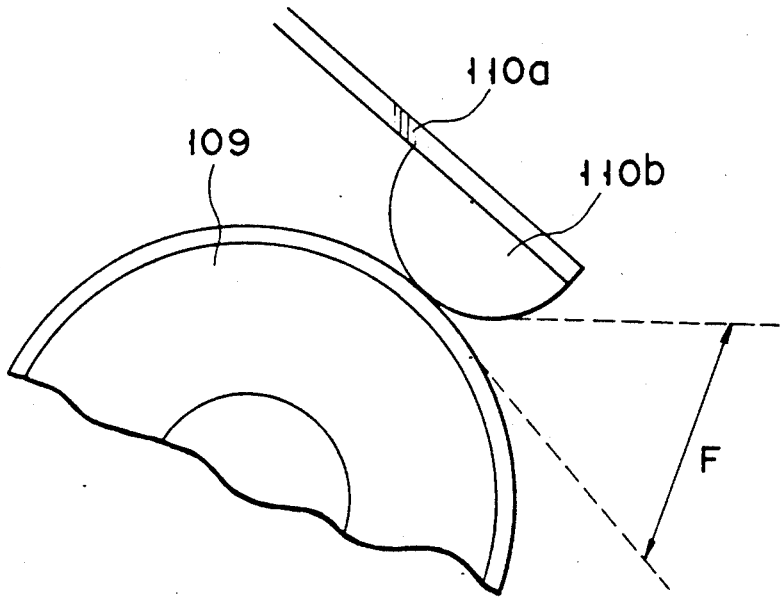
FIG. 2 is a schematic view showing a developing roller and a developer layer forming blade both according to the present invention, which are in contact with each other.

FIG. 2 is a schematic view showing a developing roller 109 and an end portion of a developer layer forming blade 110 provided thereon. As shown in FIG. 2, the blade 110 includes a metal leaf 110*a* and a chip 110*b* formed at the end thereof and is located on the development roller 109 such that the chip 110*b* is pressed against the surface of the developing roller 109. If F represents a space between the developing roller 109 and chip 110*b*, the amount of developer injected into the chip varies as the space F becomes narrower due to the chip becoming worn, which results in variations in the amount of charge applied to the developer and in the thickness of the developer. For this reason, the density of the resulting images is not uniform, the density follow-up of solid images is degraded, and defects such as fogging may occur in non-image portions. Further, since the amount of charge applied to the developer decreases, the development efficiency is lowered and thus the amount of developer consumed greatly increases. In an attempt to overcome these drawbacks, a number of devices have incorporated a blade including a charging layer formed on an elastic layer, so as to almost completely eliminate blade wear. However, when the charging layer has higher wear-resistance than the conductive layer of the developing roller, defects such as marks, flaws, and peeling occur in the conductive layer, and these appear on images.

The chip 110*b* needs to be somewhat elastic so as not to damage the surface of the developing roller. In this developer apparatus, urethane rubber having hardness of 80 degrees on JIS-A, is used as the elastic layer 110*d* of the chip 110*b*, and a conductive polyurethane coating material, which is easy to adhere to the elastic layer 110*d*, is used to form the charging layer 110*e*.

To select the conductive polyurethane coating material, the charging properties and wear-resistance of different kinds of conductive polyurethane coating materials are measured as follows and the results of the measurement are taken into consideration.

The wear resistance is known to relate to wearability. When there are materials having the same compositions, the materials have different wearablity if the materials have different coefficients at of friction.

Selection of the Charging Layer

Figure 3:
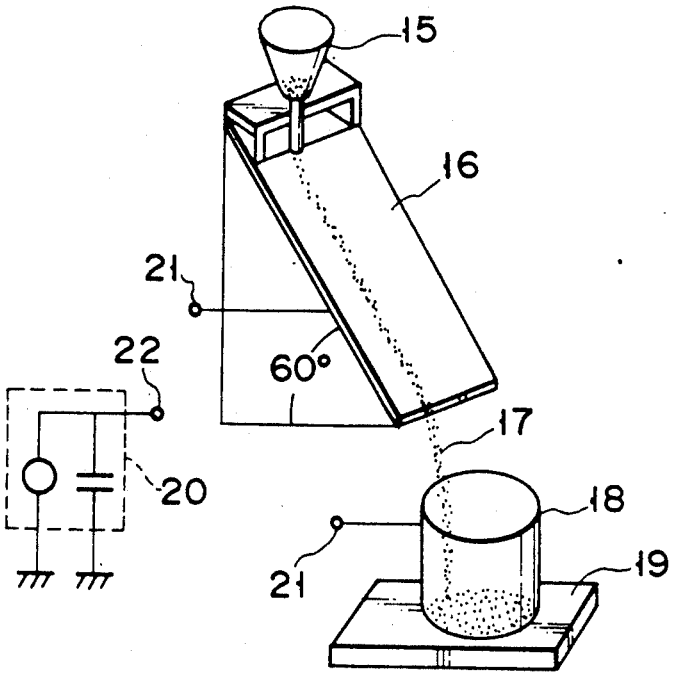
FIG. 3 is a schematic view showing an electrostatic type film surface analyzing device.

The charging properties of conductive polyurethane coating material is measured using an electrostatic film surface analyzing device as shown in FIG. 3. This device comprises a substrate having a film 16 coated with a conductive polyurethane material on its surface and inclined at 60 degrees to the horizontal, a contact powder supplier member 15 located above the substrate 16 and housing contact powder 17 for measurement, a contact powder receiving container 18 for receiving the contact powder 17 supplied onto the film 16 from the supplier 15, a fixing table 19 for fixing the container 18, and an electrometer 20 having an external terminal 22 connected to external terminals 21 of the substrate and container 18. In the analyzing device the contact powder 17 is flowed down along the film 16 and an amount of charge generated by friction therebetween on the electrometer 20 is displayed. The measurement conditions are as follows.

Temperature: 25° C.

Moisture: 55%

Contact Powder (produced by Powder Tech Co.): FL2030

Amount of powder flowing on the film: 1.3 g

Length of powder flowing on the film: 90 mm

Four different conductive polyurethane coating materials A to D are evaluated on the above conditions using the analyzing device. SPALEX DH20Z313 (produced by NIHON MIRACTRON CORPORATION) is used as the polyurethane coating material A, and ELECTROPACK Z279 (produced by TAISEI KAKOU CORPORATION) is used as the polyurethane coating material D. The conductive polyurethane coating materials B and C are obtained by applying different change control agents to the polyurethane A to improve the charging properties. The four different materials so obtained are represented in Table 1.

TABLE 1

| Type of Polyurethane Coating Material | Charge Control Agent | Amount of Charges (nm) |
|---|---|---|
| A | NONE | −260 |
| B | Addition | +590 |
| C | Addition | +497 |
| D | NONE | +623 |

As is evident from the Table 1, the conductive polyurethane coating material D has the largest amount of charges.

Figure 4:
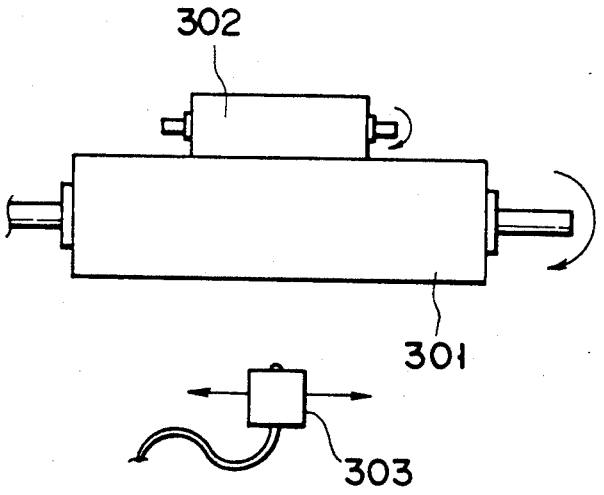
FIG. 4 is a schematic view showing a device having wear-resistance.

Next, the wear-resistance of the four conductive polyurethane coating materials are measured. FIG. 4 is a schematic view showing a measuring device for measuring the wear-resistance. The measuring device comprises a test sample 301 applied to the surface of an aluminum tube, an abrasive member 302 arranged in contact with the surface of the test sample 301, and a laser length measuring machine 303 provided above the surface of the test sample 301. The surface of the test sample 301 is worn by bringing the abrasive member 302 constituted of metal or resin into contact with the surface of the test sample 301 while rotating the test sample 301, and the amount of wear can be checked by measuring the thickness of the test sample 301 before and after the test sample is worn. The thickness of the test sample 301 is measured at its five locations using a laser length measuring machine (Tokyo KOUDENSI CORPORATION), and the average of the measured thicknesses of the five locations in used as an amount of wear. The test sample 301 is worn while being rotated for 20 hours. The results are shown in Table 2.

TABLE 2

| Type of Polyurethane Coating Material | Charge Control Agent | Amount of wear |
|---|---|---|
| A | NONE | 50 |
| B | Addition | 110 |
| C | Addition | 90 |
| D | NONE | 75 |

As is apparent from Table 2, the conductive polyurethane coating material A has the highest wear-resistance, followed by the conductive polyurethane coating materials D, C and B.

It is thus understood from the above that the conductive polyurethane coating material C is the most suitable for relatively increasing the amount of charge in a positive charge direction and making the wear-resistance lower than that of the developing roller. The conductive polyurethane coating material C is of a solution type.

The coefficient of friction and elongation of the conductive polyurethane coating material C are measured. The coefficient of friction is 0.7 measured by HEYDON-type coefficient of friction measuring apparatus on condition that sample shape is cylindrical having 24 cm of diameter and 30 m of Length, loading is 100 g, and measurement is performed on PPC paper P-50S (Toshiba corporation) and the elongation is 500% JIS K7311.JIS represents Japanese Industrial Standards which were established in Japan for use in measurements of industrial products.

It is desirable that the coefficient of friction of the charging layer used in the present invention is 0.3 to 1.0, and more desirable that the coefficient is 0.2 to 1.2. If the coefficient of friction exceeds 1.2, toner is set to the developing roller and, if it does not exceed 0.2, it causes lack of a charge amount of toner. It is also desirable that the degree of extensibility is not less than 150%. If the degree of extensibility is less than 150% it causes cracking and peeling in the charging layer.

The elastic layer **110*d*** formed of urethane rubber is coated with the conductive polyurethane coating material C by the method described below.

Formation of the Charging Layer

A diluent solvent of dimethylformamide (DMF) and methyl ethyl ketone (MEK) with 1:1 mixture ratio was added to a stock solution of the conductive polyurethane coating material C such that the amount of the diluent solvent is equal to that of the stock solution. The diluent coating material is sufficiently agitated and then the elastic layer **110*d* of chip 110*b* cleaned by a solvent is coated with the diluent coating material using a spray method. After the coating, the elastic layer is dried in the air for about two hours and then subjected to a thermal treatment for twenty minutes at a temperature of 100° C., resulting in the charging layer 110*e* having a thickness of about 50 μm. The thickness of the charging layer 110*e*** can be varied from 10 μm to 300 μm with spraying time and viscosity of the coating material.

As shown in FIGS. 1A and 1B, the chip **110*b* is bonded to the metal leaf 110*a* and the seal members 110*c* formed of urethane foam are attached to the metal leaf 110*a*, thereby forming the developer layer forming blade 110. Since each of the seal members 110*c* is thicker than the chip 110*b*, in both the ends of the metal leaf 110*a* the developer can reliably be sealed to prevent it from moving to outside of its end directions when the chip 110*b* is pressed on the developing roller. The seal members 110*c* are arranged so as to wrap the end portions of the developer layer forming blade 110. The peeling of the chip 110*b*** due to a flow of the developer can thus be prevented and the chip can be stabilized for a long time.

Since the chip **110*b* is mounted on the metal leaf 110*a*, a uniform developer layer can be easily and reliably formed by the elasticity of the metal leaf 110*a*. Since pressure irregularity tends to occur between the developing roller and chip 110*b*** and affects the developer layer or formed images, the precision in the tangential direction between them is significant.

Figure 5:
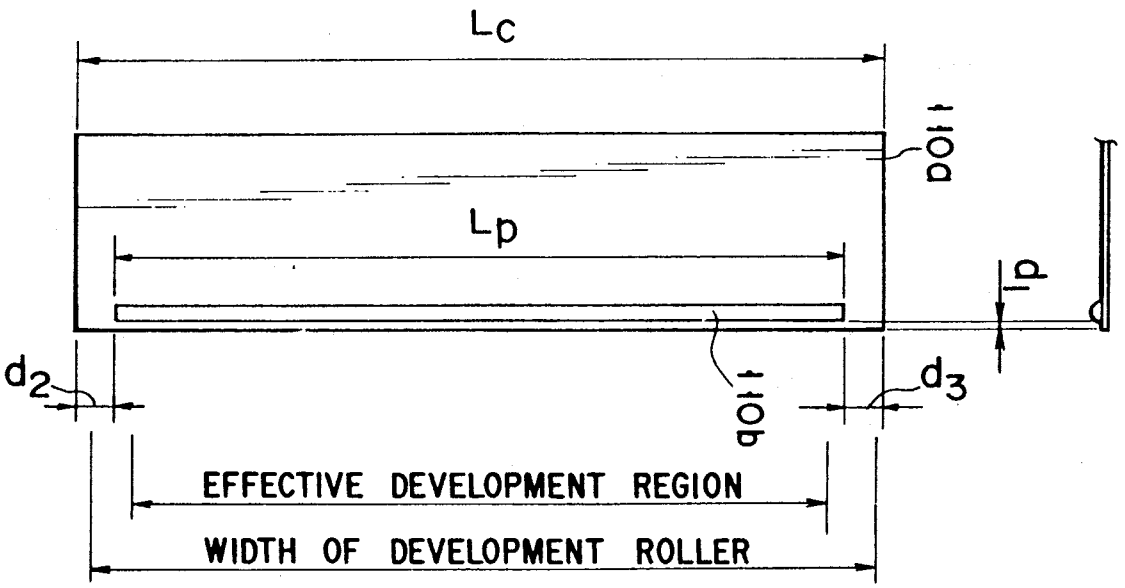
FIG. 5 is a plan view showing an arrangement of a metal leaf and a chip in the developer layer forming blade used in the developing apparatus of the present invention.

In the developer layer forming blade 110, as shown in FIG. 5, the chip 110*b* is mounted on the metal leaf 110*a* so as to have a space of d1 away from the end of the metal leaf 110*a*. The space is used to press and position the chip when it is mounted on the metal leaf by molding or bonding. If the chip is sufficiently pressed and positioned, the structure of the metal leaf can be ensured in its transversal direction and accordingly the precision in the tangential direction between the chip and developing roller can be improved. If the space d1 is too large, a developer layer is badly formed by the pressure exerted by the flow of the developer. It is thus desirable that the space d1 range between 0.5 mm and 5 mm and more desirable that it range between 0.5 mm and 2 mm. The space d1 is set to 0.5 mm in the embodiment of the present invention. The length Lp of the chip 110*b* in its longitudinal direction is smaller by spaces d2+d3 than the length Lc of the metal leaf 110*a* in its longitudinal direction. The length Lc is equal to Lp+d2+d3. The seal members 110*c* formed of urethane foam are attached to the spaces d2 and d3. Since it is desirable that each of the spaces d2 and d3 be 3 mm or more in view of the width of each of the seal members, d2+d3 are 6 to 30 mm, preferably 6 to 20 mm. The length Lp of the chip 110*b* is set larger than an effective development width, and the length Lc of the metal leaf 110*a* is set to such a length that the metal leaf overhangs a side seal of the developing roller.

A developing apparatus to which the foregoing developer layer forming blade 110 is actually applied will be described.

Figure 6:
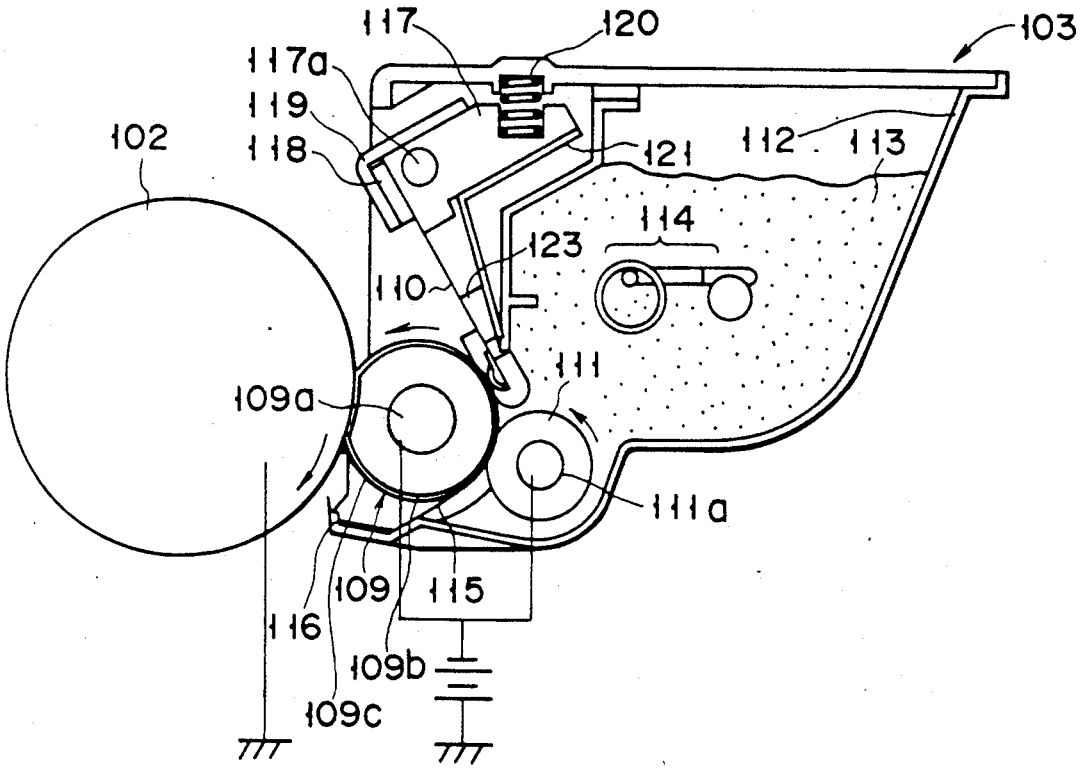
FIG. 6 is a schematic view showing a developing apparatus according to an embodiment of the present invention.

FIG. 6 is a schematic view showing a contact type non-magnetic single component developing apparatus 103 according to an embodiment of the present invention. In this developing apparatus, a non-magnetic developer layer is formed on the surface of a developing roller 109 having conductivity and elasticity and brought into contact with an organic photosensitive drum 102 to perform development. Since the developing apparatus necessitates neither a carrier nor an Mg roller nor a developer density controller, it can be made small in size and low in cost. A process of the development will now be described.

As shown in FIG. 6, a non-magnetic developer 113 in a developer container 112 is agitated by a mixer 114 and sent to a developer supply roller 111. The developer 113 is then supplied to the developing roller 109 by the developer supply roller 111. Part of the developer 113 is adhered to the developing roller by a mechanical carrying force of the developing roller 109 and an electrostatic force of charges caused by the friction between the developer on one hand and the developing roller and the other members on the other hand. The amount of the developer to be carried is controlled by the blade 110 which is held by blade holders 117 and 119 and a spacer 118 and contacting the developing roller 109 and, at the same time, triboelectric charging of the developer is caused by the friction between the developing roller and blade 110. The developing apparatus performs reversal development using the organic photosensitive drum 102 which is negatively charged. Therefore, the developer is negatively charged and the blade 110 is formed of a material susceptible to negative charges.

Figure 7:
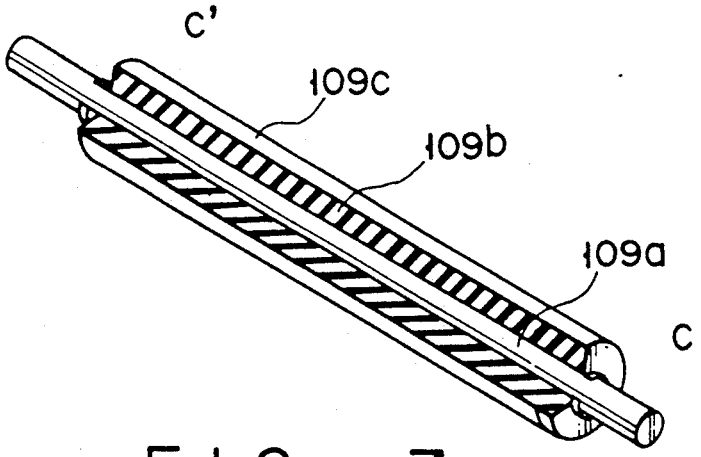
FIG. 7 is a cutaway sectional view showing an example of the developing roller shown in FIG. 1.

FIG. 7 is a perspective sectional view of the developing roller 109. The developing roller 109 includes a metal shaft 109*a*, an elastic layer 109*b* formed on the metal shaft 109*a*, and a conductive layer 109*c* formed on the elastic layer. While the potential at the surface of the photosensitive drum is −500 V, the development bias voltage of −200 V is applied to the metal shaft 109*a* of the developing roller 109 through a protective resistor, and the developing roller 109 rotates in contact with the photosensitive drum 102 at a speed, which is about 1.2 to 4 times as high as that of the photosensitive drum 102, with an interval (development nip) of about 1 to 4 mm between the developing roller 109 and the photosensitive drum 102. Since a developer particle is charged at a development position, a very sharp image with less fog can be formed. The remaining developer is returned to the developer container through a recovery blade (Mylar film) 115. If the developer drops from the developing roller 109 for any cause, the inside of the developing apparatus or transfer paper is made dirty. To solve this problem, a member 116 such as a plasticizer, which reacts on the developer to allow the developer to be welded thereto, is provided under the developing roller 109 and the development welded to the member 116 does not fall even though the developing apparatus 103 is turned upside down. In FIG. 6, reference numeral 121 indicates a buckle plate attached to the blade holder 117. The buckle plate is placed into contact with a foamed member 123 formed of such as PF-PET-ET (Phenol-formaldehyde-polyester-Ether), PF-PET-ES (Phenol-formaldehyde-Polyester-Ester) or the like and attached to the reverse surface of the blade 110 to seal the developer and prevent the blade 110 from vibrating, thereby reliably forming a developer layer on the developing roller 109.

The blade 110 is pressed against the developing roller 109 by a rotating shaft 117*a* of the blade holder 117 and a plurality of compressed springs 120. Since the compressed springs 120 have a spring constant lower than that of a metal leaf material of the blade, a good developer layer can be maintained.

In the contact type developing apparatus, the developing roller 109 needs to have conductivity and elasticity. The simplest structure to meet the need is a combination of a metal shaft and a conductive rubber roller. It is desirable to set the rubber hardness of the conductive rubber roller to 50°, or less on JIS to obtain a sufficient interval between the developing roller and the photosensitive drum, and the surface of the developing roller needs smoothing to carry the developer with it pressed against the surface of the developing roller. The developing roller shown in FIG. 6 has a two-layered structure including the elastic layer 109*b* and conductive layer 109*c* both surrounding the metal shaft 109*a*.

Though a conductive or nonconductive elastic layer can be selected as the elastic layer 109*b*, it is preferable that the elastic layer 109*b* be conductive in view of peeling or flaw caused in the conductive layer 109*c*. Since the elastic layer 109*b* is pressed against the blade 110 and photosensitive drum 102, a problem of permanent set (%) on JIS K6301 occurs when the developing apparatus is packed or if it is left to stand. An irregular image is formed if the permanent set exceeds 10%. It is thus better that the compression strain of the elastic layer 109*b* is 10% or less and preferably 5% or less. The higher the rubber hardness, the smaller the permanent set. It is thus important to select a suitable material for the elastic layer and to balance the rubber hardness with the permanent set. In the embodiment of the present invention, conductive urethane rubber is selected as a material having the characteristics required for the elastic layer 109*b*. In addition to the conductive urethane rubber, conductive EPDM rubber or conductive silicone rubber can be used.

The hardness of the elastic layer 109b formed of the conductive urethane rubber is measured by an A-type hardness meter of the JIS K6301, and 30 degrees is obtained as the hardness. The outer diameter of the elastic layer 109b is 18 mm. Further, the electrical resistance of the conductive urethane rubber is $3.4\times10^3$ Ω.cm which is obtained by measuring the current when the developing roller is arranged in parallel with a stainless roller having a diameter of 60 mm at an interval of 2 mm and a difference in voltage between the metal shafts of both the rollers is set to 100 V. The permanent set of the elastic layer 109b is 3.8%, which is obtained by the measurement method indicated in the JIS K6301.

Since the conductive layer 109c of the developing roller is brought into contact with the developer or photosensitive drum, it needs to prevent the developer and photosensitive drum from being contaminated with plasticizer, vulcanizer, process oil, or the like oozing from the conductive layer. The smoothness of the surface of the conductive layer 109c is desirably 3 μmRz or less and, if it exceeds that value, the irregularities on the surface of the conductive layer may appear on an image. To achieve the smoothness of 3 μmRz, the conductive layer 109c having a considerably large thickness is formed on the elastic layer 109b and then post-processed (abraded) to have a predetermined outer diameter and surface roughness. This method increases the cost. It is thus better to form the conductive layer 109c without the post-process and to properly select the surface roughness of the elastic layer 109b, the thickness of the conductive layer 109c, and the viscosity of a coating material used to form the conductive layer 109c.

The conductive layer 109c has conductivity of $10^3$.Ωcm which is obtained by dispersing conductive carbon particles into polyurethane resin, and its wear-resistance is higher than that of the charging layer of the blade. It is preferable that the wear-resistance is two times or more as high as that of the charging layer of the blade, and the coefficient of friction of the conductive layer is 0.3 to 1.0 and more desirably is 0.2 to 1.2 times that of the charging layer of the blade, determined by HEYDON coefficient of friction measurement apparatus. If the coefficient of friction exceeds 1.2, toner is set to the developing roller and, if it is less than 0.2, it causes lack of a charge amount of toner. The degree of extensibility of the conductive layer is favorably 150% or more. If the degree of extensibility exceeds 150% it causes cracking and peeling.

The conductive polyurethane coating material A, which has the highest wear-resistance as shown in Table 1, is used as the polyurethane resin. The surface of the elastic layer 109b formed of conductive urethane rubber is coated with the conductive polyurethane coating material A, then dried and thermally treated, in accordance with the following process, thereby forming the conductive layer 109b.

A diluent solvent of methyl ethyl ketone (MEK) and tetrahydrofuran (THF) with 1:1 mixture ratio is added to a stock solution of the conductive polyurethane coating material A such that the amount of the diluent solvent is equal to that of the stock solution. An acrylic resin charging control agent is added to the diluent solvent at 3% of the conductive polyurethane coating material A. Since the conductive polyurethane coating material A is charged to the same polarity as that of the developer as is apparent from Table 1, the charging control agent is added to charge the conductive polyurethane coating material A to a polarity opposite to that of the developer. With the addition of the charging control agent, the amount of charges of +603nC, which is close to that of the conductive polyurethane coating material D, can be obtained. The coating material diluted in the diluent solvent is sufficiently agitated and then the surface of the elastic layer 109b cleaned by a solvent is coated with the coating material using the dipping method. The speed at which the elastic layer 109b is raised is 2.5 mm per second. After the coating, the elastic layer is dried in the air for about thirty minutes and then subjected to a thermal treatment for twenty minutes at a temperature of 100° C. The conductive layer 109c is thus formed to have a thickness of 70 to 80 μm. The thickness of the conductive layer 109c can be varied within a range between 10 μm and 500 μm by changing the raise speed of the dipping method and the viscosity of the coating material. The developing roller 109 having resistance of $5\times10^3$.Ωcm between the metal shaft 109a and the conductive layer 109c, rubber hardness of 35° measured by the A-type hardness meter of the JIS K 6301, and surface roughness of 3 μmRz, is obtained by the above process. The coefficient of friction of the conductive layer is 0.58 measured by the Heydon type coefficient measurement apparatus, and the degree of extensibility thereof is 80% on JIS K7311.

A case where the contact type single component non-magnetic developing apparatus 103 is applied to a laser printer for forming a latent image by irradiating an organic photosensitive drum having a negatively-charged surface with a laser beam and visualizing the latent image by the reversal development, will be next described.

The reversal development is executed on condition that the potential of an image portion, i.e., the potential of an exposed portion is −80 V, the potential of a non-image portion, i.e., the potential of an unexposed portion is −500 V, a development bias is −200 V, a contact area between the photosensitive drum 102 and developing roller 109 is 1.5 mm in width, and a circumferential speed ratio of the photosensitive drum to developing roller is 1 to 2. A printing sample including a sharp line image having a density of 1.4 and free from fog and a solid image having no irregularities can be obtained by the above reversal development. A life test for the developing apparatus is carried out with respect to ten thousand sheets and finally a considerably satisfactory image having the same quality as that of the initial image can be formed even after the life test is completed.

Figure 8:
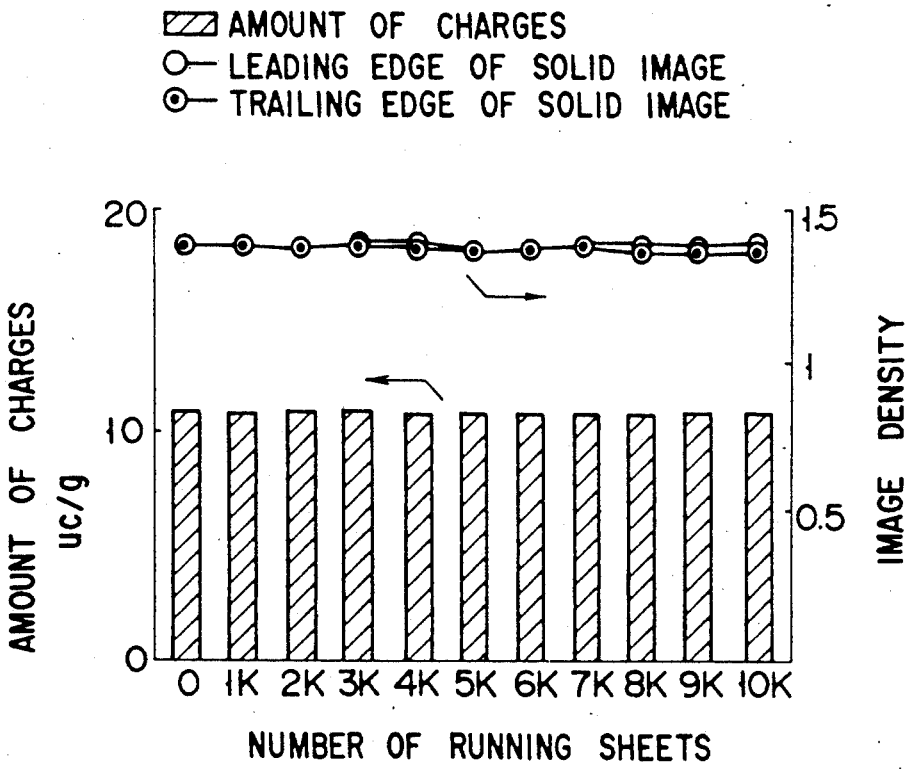
FIG. 8 is a graph showing a relationship between the number of image forming sheets on one hand and the density of images and the amount of charges applied to a developer on the other hand.
Figure 9A:
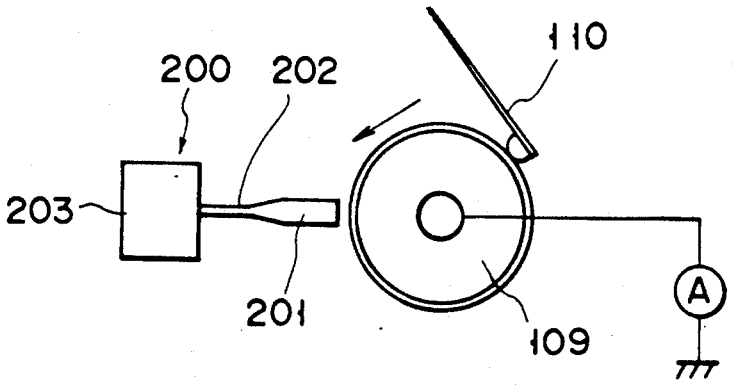
FIG. 9A is a schematic view showing a method of measuring the amount of charges applied to the developer on the development roller.
Figure 9B:
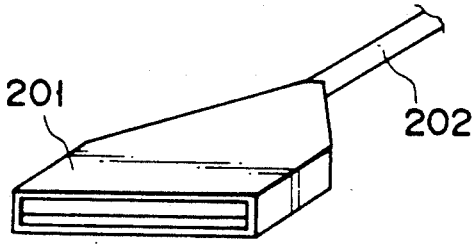
FIG. 9B is a perspective view showing an apparatus for measuring the amount of charges using the method shown in FIG. 9A.

FIG. 8 is a graph showing a relationship between the image density and the amount of charges applied to the developer of one to ten thousand sheets. The image density is measured by using the density of a solid image, and the amount of charges is obtained by using a charge amount measuring device 200 as shown in FIG. 9A every time the developing roller rotates ten times. As shown in FIG. 9A, the charge amount measuring device 200 comprises a suction pump 201 opposing the developing roller 109 and a Faraday cage 202 which is a conductive container having an opening 203. The device 200 sucks the developer from the surface of the developing roller 109 into the Faraday cage 202 to measure the average amount of charge per unit of weight of the developer from the charge generated by electrostatic induction.

As is apparent from the graph shown in FIG. 8, if the developing apparatus described above is used, the image density hardly changes even in the last one of the ten thousand sheets, and the amount of charges hardly changes. An image of high quality can thus be formed by the developing apparatus. Since the amount of wear of the chip 110*b* is small, a change in the amount of undesired developer coating and the abrasion wear of the chip 110*b* and a contact width between the chip 110*b* and the developing roller 109 are small and fall within a negligible range.

As described above, according to the developing apparatus of the present invention, the conductive layer of the developing roller can be prevented from being worn, and defects such as marks, flaws, and peeling can be prevented from being caused in the conductive layer since the charging layer of the end portion of the developer layer forming blade is worn easier than the conductive layer of the developing roller. Using the developing roller and developer layer forming blade, the developer can sufficiently be charged, and a high-definition image free from irregular image density and fogginess of a non-image portion, can be formed and the high-definition image can be maintained for a long time.

Figure 10:
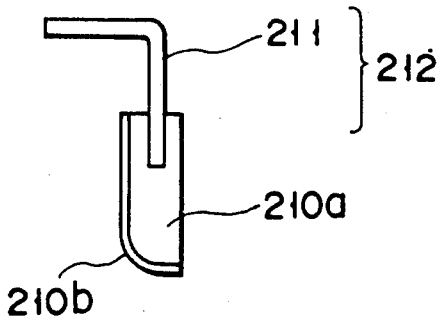
FIG. 10 is a view showing another example of the developer layer forming blade according to the present invention.

FIG. 10 is a cross-sectional view showing a developer layer forming blade 212 according to another embodiment of the present invention.

The developer layer forming blade 212 comprises a supporting member 211, a urethane rubber plate 210*a* having a thickness of 3 mm and a curved surface with a radius of 1.5 mm contacting the developing roller, and a conductive polyurethane layer 210*b* corresponding to the polyurethane coating material C shown in Table 2 and applied to the end portion of the urethane rubber plate. The conductive polyurethane is applied to the plate by the diluent solvent and the coating method as in the above embodiment. The developer layer forming blade 212 can be applied to the developing apparatus shown in FIG. 6. In this developing apparatus, the central portion of the curved surface of the developer layer forming blade 212 is pressed against the developing roller 109 at predetermined pressure. In this embodiment, the pressure at which the blade is pressed against the developing roller is set to 1000 g by a plurality of springs. In this embodiment, the structural elements of the developing apparatus other than the blade 212 are the same as those of the apparatus shown in FIG. 6.

A life test for the developing apparatus according to the second embodiment is performed with respect to ten thousand sheets, and finally a considerably good image sample can be obtained though the amount of charges is slightly smaller than that in the developing apparatus according to the first embodiment.

In the above embodiment, the developer layer forming blade 212 is located against the developing roller 109; however, the blade 110 can be located with the roller. Though the end of the blade 212 has a curved surface, it can be shaped like a plate or formed so as to press a plate-like member or an edge.

As described above, in the developing apparatus according to the present invention, the developer is sufficiently charged, and a stable high-definition image can be formed without defects such as irregularities of image density and fogginess even though the apparatus is used for a long time.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A developing apparatus comprising:

developing means for supplying developing agent to an image bearing member to develop a latent image, said developing means having a conductive layer on a surface thereof and arranged opposite to the image bearing member; and means for forming a developing agent layer on the conductive layer of said developing means, said forming means having a charging layer having wear-resistance equal to or lower than that of the conductive layer of said developing means, wherein said conductive layer is made from conductive polyurethane resin.

2. The developing apparatus according to claim 1, wherein said charging layer is made from conductive polyurethane resin.

3. The developing apparatus according to claim 1, wherein said conductive layer has a coefficient of friction ranging from 0.3 to 1.0.

4. The developing apparatus according to claim 1, wherein said charging layer has a coefficient of friction ranging from 0.3 to 1.0.

5. The developing apparatus according to claim 1, wherein said forming means has said charging layer and an elastic layer on a surface opposite to the conductive layer of said developing means.

6. The developing apparatus according to claim 5, wherein said elastic layer is made of a material selected from the group consisting of EPDM rubber, silicone rubber, NBR rubber, and urethane rubber.

7. The developing apparatus according to claim 1, wherein said developing means has wear-resistance 2 times as high as that of said developing agent layer forming means.

8. A developing apparatus comprising:

an elastic developing roller for supplying developing agent to an image bearing member to develop a latent image, said developing roller having elasticity and including a conductive layer on a surface thereof and arranged to be in contact with the image bearing member; and a developer layer forming blade for forming a developer layer on the conductive layer of said developing roller, said forming blade having a charging layer having wear-resistance equal to or lower than that of the conductive layer of said developing roller, wherein said conductive layer is made from conductive polyurethane resin.

9. The developing apparatus according to claim 8, wherein said charging layer is made from conductive polyurethane resin.

10. The developing apparatus according to claim 8, wherein said conductive layer has a coefficient of friction ranging from 0.3 to 1.0.

11. The developing apparatus according to claim 8, wherein said charging layer has a coefficient of friction ranging from 0.3 to 1.0.

12. The developing apparatus according to claim 8, wherein said developer layer forming blade has said charging layer and an elastic layer on a surface opposite to the conductive layer of said elastic developing roller.

13. The developing apparatus according to claim 12, wherein said elastic layer is made of a material selected from the group consisting of EPDM rubber, silicone rubber, NBR rubber, and urethane rubber.

14. The developing apparatus according to claim 8, wherein said elastic developing roller has wear-resistance 2 times as high as that of said developer layer forming blade.

* * * * *